US008047411B2

(12) United States Patent
Thatcher

(10) Patent No.: US 8,047,411 B2
(45) Date of Patent: Nov. 1, 2011

(54) REAR ENTRY BLADDER FOR USER-BORNE ATHLETIC PACKS

(75) Inventor: Bryce Thatcher, Sugar City, ID (US)

(73) Assignee: Penquin Brands, Inc., Sharon Hill, PA (US)

( * ) Notice: Subject to any disclaimer, the term of this patent is extended or adjusted under 35 U.S.C. 154(b) by 424 days.

(21) Appl. No.: 11/657,899

(22) Filed: Jan. 25, 2007

(65) Prior Publication Data

US 2008/0179349 A1 Jul. 31, 2008

(51) Int. Cl.
*A45F 5/00* (2006.01)

(52) U.S. Cl. ..... 224/148.2; 224/653; 222/175

(58) Field of Classification Search .... 224/148.2–148.6, 224/653, 645, 587, 652; 222/175
See application file for complete search history.

(56) References Cited

U.S. PATENT DOCUMENTS 3,679,108 A * 7/1972 Ingram ..... 224/644
5,547,461 A * 8/1996 Levis ..... 602/19
5,975,387 A * 11/1999 Gleason et al. ..... 224/148.2
5,984,154 A * 11/1999 Scicluna ..... 224/153
6,026,961 A * 2/2000 McCarthy et al. ..... 206/576
6,325,262 B1 * 12/2001 Thompson ..... 224/628
6,655,565 B2 * 12/2003 Godshaw et al. ..... 224/653
6,764,064 B2 7/2004 Sturm et al.
6,837,409 B2 1/2005 Lemanski, II
6,892,915 B2 5/2005 Mares
6,908,015 B2 6/2005 Choi et al.
7,044,343 B2 5/2006 Anue
2004/0238571 A1 * 12/2004 Noell et al. ..... 222/175
2006/0032883 A1 * 2/2006 Moreno et al. ..... 224/627
2006/0151534 A1 * 7/2006 Mares ..... 222/175
2006/0261115 A1 * 11/2006 Gracer ..... 224/653
2007/0170219 A1 * 7/2007 Ballarta et al. ..... 224/645

* cited by examiner

*Primary Examiner* — Justin Larson
*Assistant Examiner* — Corey Skurdal
(74) *Attorney, Agent, or Firm* — John J. Skinner, Jr.; Michelman & Robinson, LLP

(57) ABSTRACT

A user-borne athletic pack having an easy to access water/liquid bladder through a rear entry back-flap is presented. A construction of the athletic pack allows for a separate rear compartment containing the bladder to be accessed by unfastening of a back-flap. The rear compartment is separated from the front compartment via material integrally connected on the inside of the athletic pack. The rear access back-flap and rear compartment allows for unhindered access, storage and control of the water bladder in either its full or empty state.

7 Claims, 5 Drawing Sheets

REAR ENTRY BLADDER FOR USER-BORNE ATHLETIC PACKS

FIELD OF THE INVENTION

The present invention is generally directed to a user-borne athletic pack that allows for a "rear entry" access to a liquid storage bladder, and more particularly, to the construction and design of a user-borne athletic pack that features a back-flap and mesh webbing for easy access to and storage control of a liquid's storage bladder in and from the rear of the pack.

BACKGROUND OF THE INVENTION

Transport and storage of water, or other hydrating fluids, is an important facet in today's athletic sports as dehydration has been recognized as a serious health problem which needs to be contended with. This is especially true with regard to individual sports which take the participant off of the "beaten" trail and away from sources of hydrating liquids, such as for climbers, bikers, and runners.

Initially water or other hydrating fluids were carried in canteens, generally slung over the shoulder or clipped onto a waist belt. These, however, often proved to be bulky and cumbersome and thus often difficult to carry. Over time, fluid storage made the leap to being carried in one's backpack, also called athletic or hydration packs. This had the advantage of more evenly distributing the weight over the back and allowed for keeping the hands free.

Hydration packs generally are constructed to have a water/fluids bladder which carries the water. A tube is then connected to the bladder through which the wearer of the pack can drink. But the current athletic hydration packs have problems with access to the liquid storage bladders in that storage and control of the bladders in either the full or empty state in the pack themselves is difficult to manage. In addition, the bladders are difficult to fill due to the positioning and retention of the bladders in the pack. Such positioning of the bladders make the pack cumbersome for the users to get in and out of the packs. Also additionally a full bladder over time will tend to reposition itself in the current iterations of athletic packs thus increasing the burdens on the user in both refilling and re-positioning of the bladder in the pack and in comfortable wear and positioning on the user's back. Lastly, the current construction of the athletic packs today require threading of the water hose tubing into and out of the shoulder straps and their retainers on the shoulder straps in order to keep the tubing in place. Such routing is often undone by the disposition and movement of the bladders in today's pack.

For instance, U.S. Pat. No. 5,975,387, to Gleason et al., shows a separate bladder pack which resides between the carrying and storage back pack and the user's back. The separate bladder pack having a bladder residing in a compartment which rests against the back of a user. However, while the bladder compartment has an opening in which the bladder may be secured, the opening is shown to be on a side of the bladder compartment. While separate and distinct from the back pack, it is a separate pack from the backpack, wherein the pack bag is attached to the back side of the bladder compartment pack.

Another example is shown by U.S. Pat. No. 6,764,064 to Sturm et al., which shows a bladder compartment pack which has a zipper for accessing the compartment on the front side away from the user. The patent discloses a opening on the back side of the bladder compartment pack that does not allow for easy visibility of the bladder or easy filling of the bladder should the storage pocket on the front side of the bladder compartment pack be full of user items.

Lastly, another example is shown by U.S. Pat. No. 6,908,015 to Choi et al., which shows a bladder stored in a pack with an import in which the bladder is filled on the back side of the pack. However, this places the bladder cap in direct contact with the user's back. This potentially may cause the user irritation and discomfort due to friction between the bladder cap and the user's back.

A disadvantage of the bladders accessible by a front-flap is multi-fold. Firstly access to the bladder is often obstructed by the current contents in the pack in the front compartment. Secondly, a problem presents itself upon filling of the bladder in that the user cannot often tell exactly how full the bladder is due to such obstructions.

Thus such construction of the pack for storage does not allow for access to the bladder without entry into the main storage area/compartment. This can be problematic both in retrieval of items from the compartment and when the need arises to refill the liquid bladder. Thus, as can be see, none of these examples and from a review of packs currently in use, allow for easy access of the liquid storage bladder from the rear.

SUMMARY OF THE INVENTION

Accordingly, the present invention is directed to a user-borne athletic pack that has a rear entry compartment for containment and storage of a water/liquids bladder.

In one embodiment, the rear entry bladder compartment allows for easy entry and access to the bladder via a back-side flap, opened either by a zipper means or Velcro means, without entry into the main compartment of the athletic pack. The back-side flap contours itself to the overall shape and size of the back-side of the athletic pack, and a material barrier, integrally connected around the circumference of the inside of the pack, separates the rear bladder compartment from the main storage compartment of the pack.

In another embodiment of the present invention, a mesh webbing secures the bladder in place to prevent unwanted repositioning of the water bladder in either it's full or empty state. The mesh webbing is connected around a perimeter of the back-side flap and acts to secure the bladder to the flap.

These embodiments allow for placement of the water bladder against the back panel, that is the panel of the athletic pack placed against the carriers/wearer's back, and allows for more efficient placement and distribution of the weight from the bladder. In addition, this embodiment allows the owner to unzip the back panel, easily access the bladder, open the cap on the bladder, fill it and close it without disturbing the contents of the remainder of the pack.

The present invention, including its features and advantages, will become more apparent from the following detailed description with reference to the accompanying drawings.

DETAILED DESCRIPTION

FIGS. 1 through 5 show the various embodiments of a user-borne athletic pack which allows for the advantageous feature of easy rear access to a water/liquid storage bladder. The water/liquid storage bladder is compartmentalized in a separate rear-side compartment from the remainder of the pack's content containing compartments.

Figure 1:
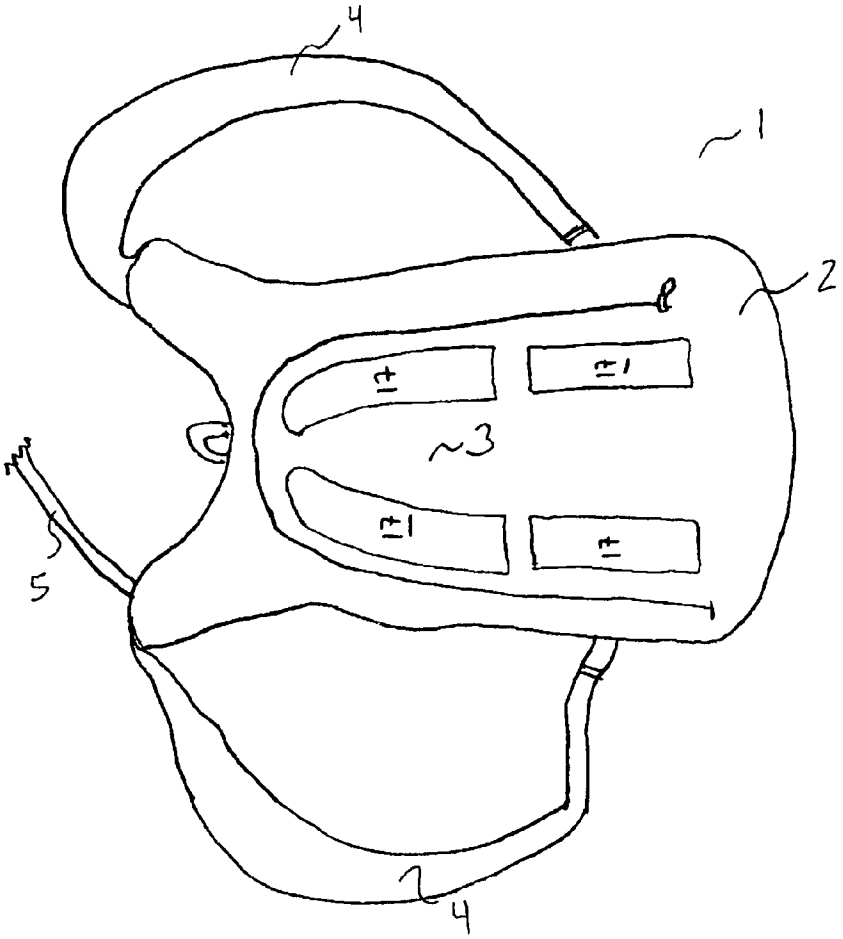
FIG. 1 is an illustration of a top plan view looking at the "rear" side of the user-borne athletic pack with the rear compartment closed, according to an embodiment of the present invention.

Referring now to FIG. 1, a top-plan view looking at the rear-side 2 (i.e., the side placed against a user's back) of a user-borne athletic pack 1 is shown. The overall construction of the athletic pack 1 may or may not consist of frame, and if so having a frame being of either of an internal or external type. Shoulder straps 4, integrally connected to the pack 1, are slung over the user's shoulders and adjustable by well-known industry means. As a hydration pack, a water hose 5 exits the pack at an exit point (not shown) on the top of the shoulder harness and is utilized by the pack user to draw water through. Naturally then, when the athletic pack 1 is worn correctly, the rear-side 2 is placed against a user's back (not shown).

The rear-side 2 is constructed having a back-flap 3 which allows access to a rear storage compartment (not shown in this figure). Preferably, the back-flap 3 is constructed such that it essentially runs at least three-quarters of the entire circumferential distance of the rear-side 2. This then allows for opening of the back-flap 3 to expose the entirety of the rear storage compartment.

The back-flap 3 may be secured to the rear-side 2 via fastener 11. In a preferred embodiment as shown, fastener 11 comprises a zipper. Alternatively, the fastener may be by Velcro means, snap button or some other means by which the back-flap 3 may be securely fastened to the rear-side 2.

In an embodiment, the back-flap 3 is constructed having various panels 17 to allow for insertion of stiffeners (not shown). The panels 17 and inserted stiffeners allow the back-flap 3 to feel a bit more solid and allows for assisting in keeping the shape of the athletic pack and in form fitting against the user's back.

Figure 2:
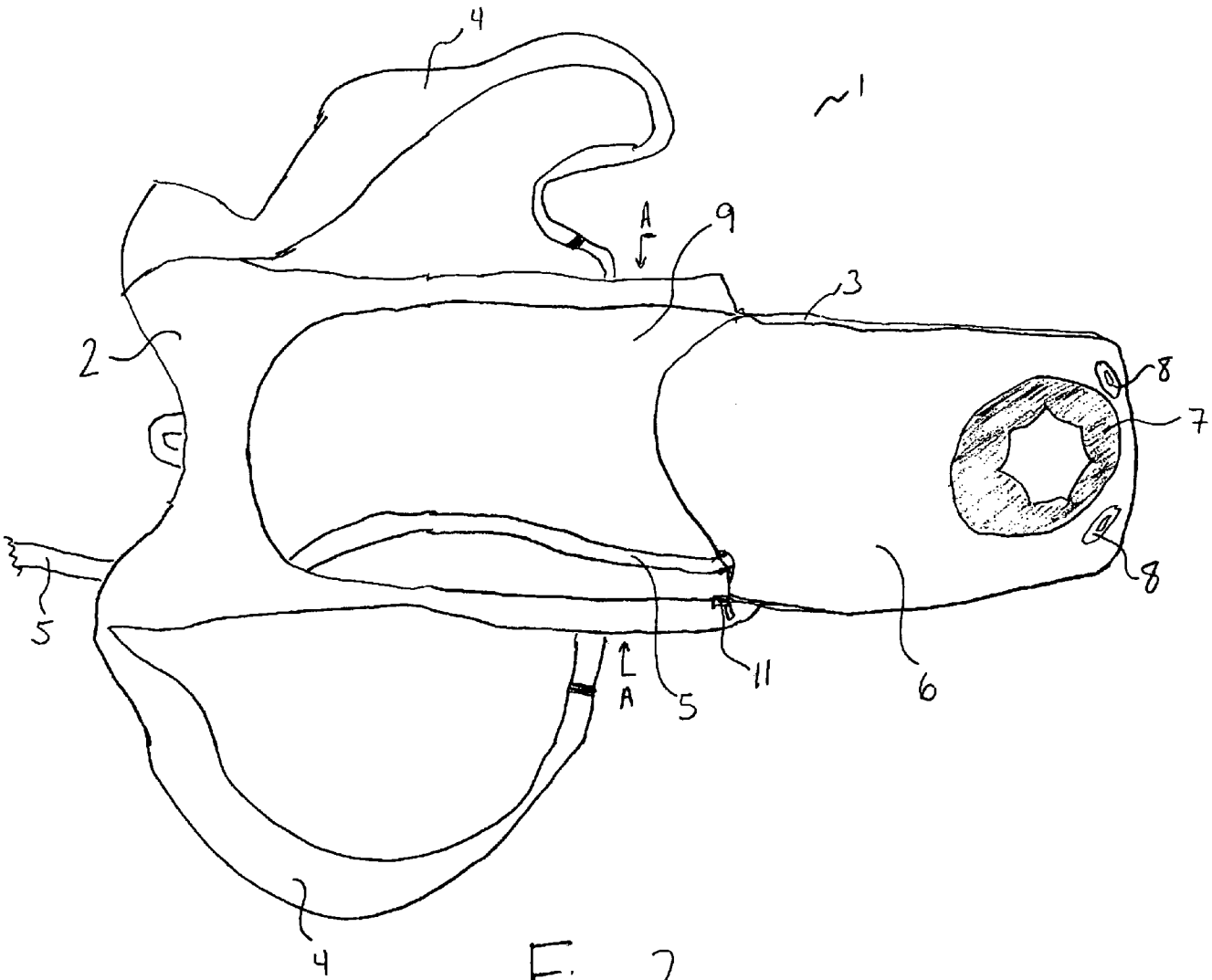
FIG. 2 is an illustration of a top plan view looking at the "rear" side of the user-borne athletic pack with the rear compartment open, according to an embodiment of the present invention.

Referring now to FIG. 2, a perspective view of the athletic pack 1 looking at the back-side 2 is shown with the back-flap 3 in an open position. On an inner side of the back-flap 3 a water/liquid storage bladder 6 is attached. The form and construction of the water/liquid bladder is by well-known means, but preferably is constructed of a water-tight polyurethane plastic material. Also preferably, the material of the bladder is transparent to some degree (or even entirely see-through) so that the water level of the bladder may be clearly discerned by viewing.

Also preferably, the bladder 6 is constructed having a bladder cap 7 which, preferably, is screw fitted to the bladder 6. The water hose 5 is attached to the bladder 6 at a bottom portion of the bladder, and may be selectively attached on the left or right side of the bladder. The water hose tubing 5 is then run up through the rear compartment 9 and out an exit point (not shown) in the shoulder strap 4.

The bladder 6 is fastened to the back-flap 3 by fasteners 8 threaded through slot holes formed through the bladder, as is well understood in the art. While the form and construction of the fasteners is by well-known means, preferably they are two plastic retainers which can be inserted through holes in the bladder.

In the present invention, the rear compartment 9 is constructed to allow for form fitting of the shape of the bladder 6 in a full water/liquid carrying state. In addition, the rear compartment 9 is preferably insulated to ensure that the water/liquid in the bladder stays at a temperature suitable for drinking. Such insulation is can be accomplished via well-known insulating techniques, but preferably is accomplished by a light weight foam insulation.

Figure 3:
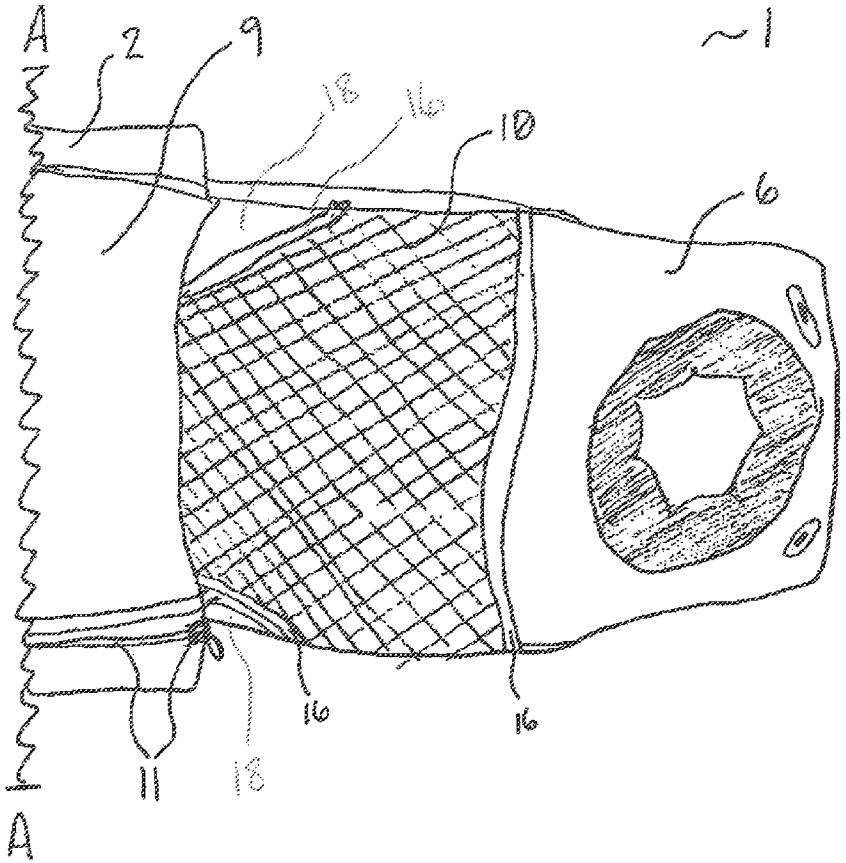
FIG. 3 is an illustration of a top plan partial view looking at the "rear" side of the user-borne athletic pack with the rear compartment open, according to an embodiment of the present invention.

Referring now to FIG. 3, a perspective partial view of the athletic pack 1 is shown as it is from cut line "A" of FIG. 2. In this partial view, the back-flap 3 is again shown in an open state thus again allowing for easy and unobstructed entry into the rear compartment 9.

In a preferred embodiment, a mesh webbing 10 is utilized in conjunction with fasteners 8 to hold the bladder 6 in position. The mesh webbing 10 keeps the bladder in place during movement and controls the overall shape of the bladder. In addition, a piece of elastic 16 may be integrally connected to the mesh webbing 10 to bias the mesh webbing against the bladder and thus assist in keeping the bladder in place.

Across the bottom of the mesh webbing 10, there may also be provided cutouts 18 on either the left or right side to allow for left or right water hose tubing 5 attachment and routing. Such embodiment allows for user preference in routing of the water hydration hose tubing 5 on the left or right side according to personal preference. In addition, further pieces of elastic 16 may be integrally connected to the mesh webbing 10 at these cutouts 18 to further add biasing effect against the bladder.

Figure 4:
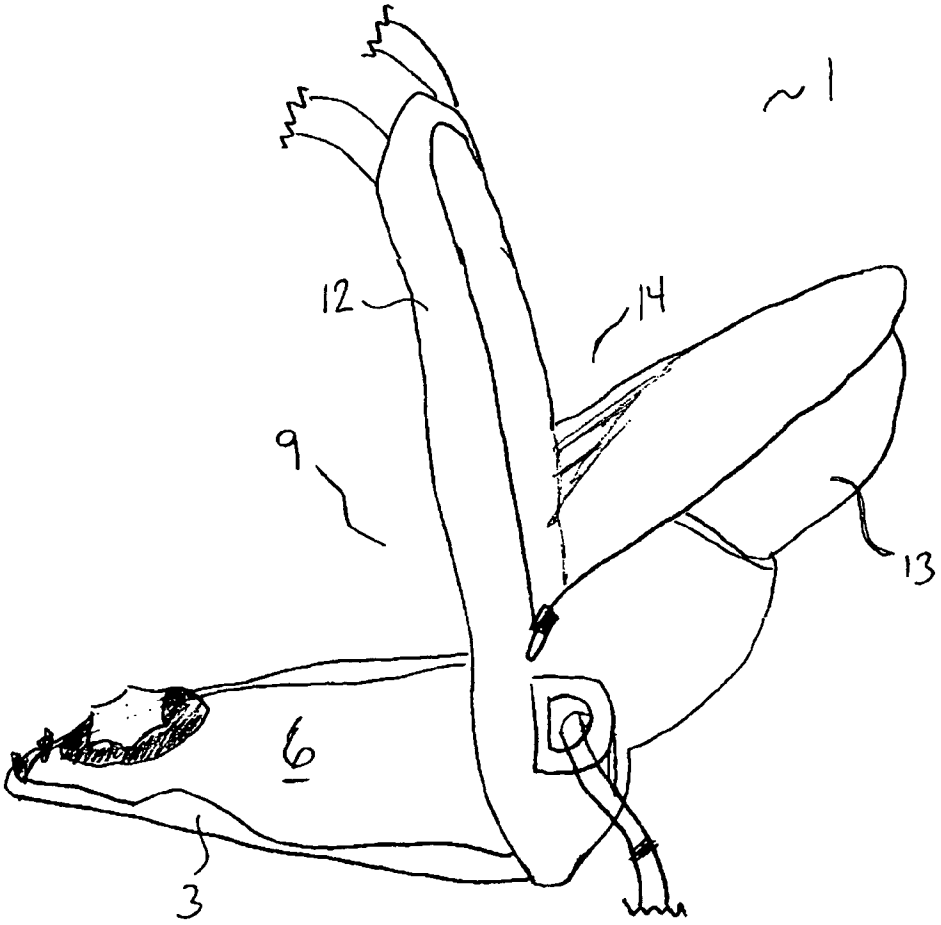
FIG. 4 is an illustration of a side perspective view of the user-borne athletic pack with both front and rear compartments open, according to an embodiment of the present invention.

Referring now to FIG. 4, a side-view of the athletic pack 1 with both a front and rear compartment is shown. As shown in this illustration access to the rear compartment 9 is separate from access to the front compartment 14, thus allowing for easy unobstructed access to the bladder 6. Thus, likewise, the front side 12 of the pack 1 allows for easy unobstructed access to a front compartment 14 by opening of a front-flap 13. Although not shown in the figure, it is to be understood that the front compartment 14 can be separated from the rear compartment 9 by integrally attached material. This then allows for easy unobstructed access by a user into each of the compartments without disturbing the contents of the separate compartments.

Filing of the bladder 6 is thus easily accomplished by unscrewing of the bladder cap 7 and moving of the back-flap 3 to position the bladder under a water hose, faucet or the like. Alternatively, the bladder 6 may easily be removed and, once filled, reinserted into the rear compartment 9 and secured into the mesh webbing 10.

Figure 5:
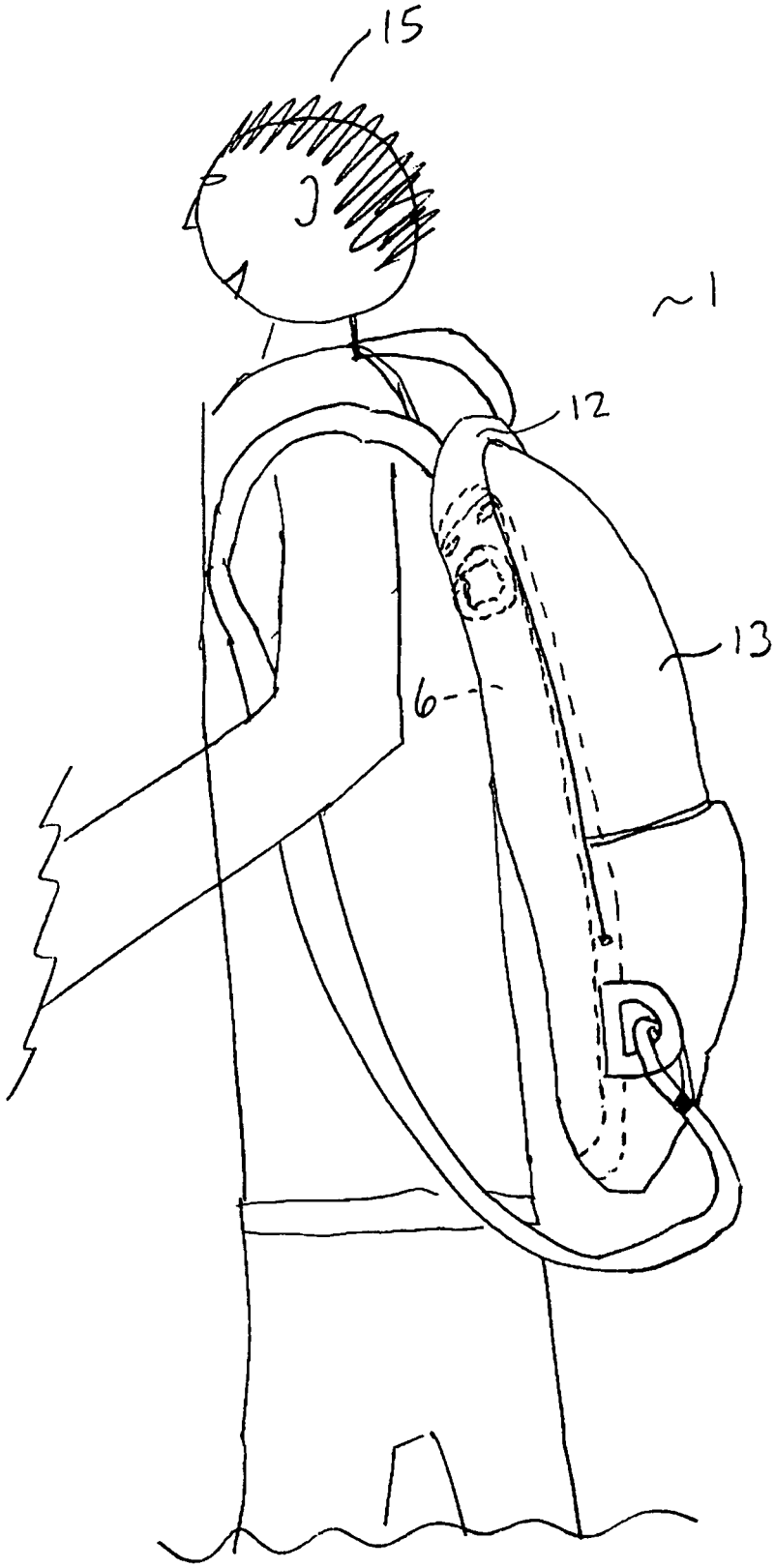
FIG. 5 is an illustration of a cross sectional perspective side view of the user-borne athletic pack with both front and rear compartments closed and appropriately worn on the back of a user, according to an embodiment of the present invention.

Referring now to FIG. 5, a side-view of the athletic pack 1 is shown as it may be worn and positioned upon a user 15. As shown in the illustration the approximate location of the bladder 6 and rear compartment 9 is shown by dashed lines in relation to the front compartment 14. The water hose tubing 5 would run from the bottom of the bladder 6 up through the rear compartment 9 through a hole in the shoulder strap 4 for easy access and drinking of the liquids contained in the bladder 6 by the user 15.

Accordingly, the current invention allows for the efficient distribution of the carrying weight caused by a full liquid bladder in that a rear compartment utilized to contain the bladder allows for distribution of such weight closest to the back. Additionally the rear access panel, or back-flap, allows for the advantage of rapid access in filling of the bladder without removal of the bladder from the pack. In addition the separate rear compartment containing only the bladder allows for easy visualization during the filling process.

In the foregoing description, the method and apparatus of the present invention have been described with reference to a specific example(s). It is to be understood and expected that variations in the principles of the method and apparatus herein disclosed may be made by one skilled in the art and it is intended that such modifications, changes, and substitutions are to be included within the scope of the present invention as set forth in the appended claims. The specification and the drawings are accordingly to be regarded in an illustrative rather than in a restrictive sense.

What is claimed is:

1. A rear-entry athletic pack allowing for access to, and storage and control of, a liquids bladder, the rear-entry athletic pack comprising:

a rear side, the rear side residing against the back of a wearer of the rear-entry athletic pack when correctly worn;

a back-side flap, the back-side flap generally following along an entire distance of and openable along at least three-quarters of the outside circumference contour of the rear side;

a rear bladder compartment, accessed by the back-side flap;

a mesh webbing, connected at a bottom end and opposing sides of an interior perimeter of the back-side flap and having at least one cut-out defining an opening at a bottom corner of the mesh webbing;

at least one fastener, positioned near a top end of an interior perimeter of the back-side flap;

a liquids bladder, removably secured flush against the back-side flap by the mesh webbing and the at least one fastener, and a hose, through which the liquids bladder's contents may be drawn, attached to the liquids bladder and routed through the at least one cut-out of the mesh webbing to outside of the rear-entry athletic pack, wherein the bottom end and opposing side connections of the mesh webbing to the interior perimeter of the back-side flap removably secures a bottom portion of the liquids bladder in position when the liquids bladder is placed inside the mesh webbing, and wherein the at least one fastener is threaded through at least one slot hole formed through a top portion of the liquids bladder and thereby removably secures a top portion of the liquids bladder in position.

2. The athletic pack according to claim 1, further comprising:

a material barrier, integrally connected to an interior of the athletic pack and which operates to separate the rear bladder compartment from a remainder of the interior space.

3. The athletic pack according to claim 1, further comprising:

a means for fastening the back-side flap to the rear side.

4. The athletic pack according to claim 1, further comprising:

a bladder cap, removably fitted to the liquids bladder and positioned so as to be on a side of the liquids bladder which is away from the athletic pack's wearer's back.

5. The athletic pack according to claim 1, further comprising:

a piece of elastic, integrally connected to the mesh webbing, which biases the liquids bladder against the back-side flap.

6. The athletic pack according to claim 1, further comprising:

at least one panel, allowing for insertion of a stiffener, residing in the back-side flap.

7. The athletic pack according to claim 1, wherein the rear bladder compartment is insulated.

* * * * *